US011376659B2

(12) United States Patent
Osako et al.

(10) Patent No.: US 11,376,659 B2
(45) Date of Patent: Jul. 5, 2022

(54) SPHERICAL SILVER POWDER

(71) Applicant: Dowa Electronics Materials Co., Ltd., Tokyo (JP)

(72) Inventors: Masaya Osako, Tokyo (JP); Taro Nakanoya, Tokyo (JP)

(73) Assignee: Dowa Electronics Materials Co., Ltd., Tokyo (JP)

( * ) Notice: Subject to any disclaimer, the term of this patent is extended or adjusted under 35 U.S.C. 154(b) by 71 days.

(21) Appl. No.: 16/772,822

(22) PCT Filed: Dec. 13, 2018

(86) PCT No.: PCT/JP2018/045808
§ 371 (c)(1),
(2) Date: Jun. 15, 2020

(87) PCT Pub. No.: WO2019/117234
PCT Pub. Date: Jun. 20, 2019

(65) Prior Publication Data

US 2021/0162495 A1 Jun. 3, 2021

(30) Foreign Application Priority Data

Dec. 15, 2017 (JP) ..... JP2017-240187
Dec. 12, 2018 (JP) ..... JP2018-232153

(51) Int. Cl.
*B22F 1/00* (2022.01)
*B22F 1/065* (2022.01)
(Continued)

(52) U.S. Cl.
CPC ..... *B22F 1/065* (2022.01); *B22F 1/05* (2022.01); *B22F 1/10* (2022.01);
(Continued)

(58) Field of Classification Search
CPC ..... B22F 2301/255
See application file for complete search history.

(56) References Cited

U.S. PATENT DOCUMENTS

2012/0049133 A1 3/2012 Irizarry

FOREIGN PATENT DOCUMENTS

JP 08176620 A 7/1996
JP 08311659 A 11/1996
(Continued)

OTHER PUBLICATIONS

Kang et al. (Amino Acid-Assisted Synthesis of Hierarchical Silver Microspheres for Single Particle Surface-Enhanced Raman Spectroscopy, J. Phys. Chem. C. 117, 10007-10012, 2013). (Year: 2013).*

(Continued)

*Primary Examiner* — Alexandre F Ferre
(74) *Attorney, Agent, or Firm* — Bachman & LaPointe, P.C.

(57) ABSTRACT

There is provided a spherical silver powder which is capable of being sintered at a lower temperature. The spherical silver powder of spherical silver particles has cavities, each of which is formed in a corresponding one of the spherical silver particles and each of which has a major axis of 100 to 1000 nm and a minor axis of 10 nm or more, the ratio of the major axis to the minor axis (major axis/minor axis) being 5 or more, the major axis being the length of the long side of a rectangle which has a minimum area and which circumscribes the outline of a cross-section of a corresponding one of the cavities on an image of the cross-section of the corresponding one of the silver particles exposed by polishing the surface of a resin after the silver powder is embedded in the resin, and the minor axis being the length of the narrow side of the rectangle.

28 Claims, 5 Drawing Sheets

(51) Int. Cl.
*B22F 1/05* (2022.01)
*B22F 1/10* (2022.01)

(52) U.S. Cl.
CPC ... *B22F 2301/255* (2013.01); *B22F 2304/058* (2013.01); *B22F 2304/10* (2013.01)

(56) References Cited

FOREIGN PATENT DOCUMENTS

| | | | |
|---|---|---|---|
| JP | 2008255370 | A | 10/2008 |
| JP | 2014185372 | A | 10/2014 |
| JP | 2015232180 | A | 12/2015 |

OTHER PUBLICATIONS

International search report for patent application No. PCT/JP2018/045808 dated Feb. 5, 2019.
Zhang et al., "Graphene oxide-wrapped flower-like sliver particles for surface-enhanced Raman spectroscopy and their applications in polychlorinated biphenyls detection", Elsevier, Applied Surface Science 400 (2017) pp. 49-56.
Supplementary European search report for application No. 18 88 8350 dated Jul. 6, 2021.

* cited by examiner

SPHERICAL SILVER POWDER

TECHNICAL FIELD

The present invention relates generally to a spherical silver powder. More specifically, the invention relates to a spherical silver powder which can be suitably used for a conductive paste for forming electrodes and circuits of electronic parts, such as substrates for solar cells and touch panels, and so forth.

BACKGROUND ART

As a conventional method for forming electrodes and circuits of electronic parts, there is widely used a method for forming a conductive film, the method comprising the steps of: adding a silver powder and a glass frit in an organic vehicle to knead them to prepare a baked type conductive paste; forming the conductive paste in a predetermined pattern on a substrate; and heating the conductive paste at a temperature of not less than 500° C. to remove organic components and sinter silver particles to cause the silver particles to be adhered to each other.

The silver powder for conductive paste for use in such a method is required to have a reasonably small particle size and a reasonably narrow range of the particle size in order to form conductive patterns having a high density and fine lines to miniaturize electronic parts and/or in order to form figure electrodes having fine lines to increase the light-gathering area of solar cells to improve the power generation efficiency thereof. It is also desired to provide a silver powder capable of being suitably used for a conductive paste which can form conductive patterns, electrodes and so forth, which can efficiently flow current, even if the conductive patterns and electrodes have a small cross-sectional area due to the fine lines.

As a method for producing a silver powder for such a conductive paste, there is known a wet reduction method for depositing a spherical silver powder by reduction by adding a reducing agent to a water reaction system containing silver ions (see, e.g., Patent Document 1).

However, if the spherical silver powder produced by the conventional wet reduction method is used for a baked type conductive paste, there is some possibility that it is not possible to sufficiently sinter silver particles to cause the silver particles to be adhered to each other even if the conductive paste is heated at a temperature of about 600° C., so that it is not possible to form a good conductive film.

In order to solve such a problem, as a method for producing a spherical silver powder which has the same particle diameter as that of a spherical silver powder produced by the conventional wet reduction method and which can be sintered at a lower temperature, there is proposed a method for producing a spherical silver powder, which has a closed (substantially spherical) cavity in each particle thereof, by depositing silver particles by reduction by mixing a reducing agent containing solution, which contains an aldehyde as a reducing agent, with a water reaction system, which contains silver ions, while causing cavitation in the water reaction system (see, e.g., Patent Document 2).

PRIOR ART DOCUMENT(S)

Patent Document(s)

Patent Document 1: JP H08-176620A (Paragraph Numbers 0008-0013)

Patent Document 2: JP 2015-232180A (Paragraph Number 0008)

SUMMARY OF THE INVENTION

Problem to be Solved by the Invention

The silver powder produced by Patent Document 2 can be sufficiently sintered to cause the silver particles thereof to be adhered to each other even if it is heated at a temperature of about 600° C.

In recent years, electronic parts are further miniaturized to cause the higher density and finer lines of conductive patterns to proceed. In order to increase the light-gathering area of solar cells to improve the power generation efficiency thereof, the finer lines of figure electrodes are caused to proceed.

In crystalline silicon solar cells, the efficiency thereof is lowered if produced electrons diffuse to a back electrode. For that reason, there are used BSF (Back-Surface-Field) solar cells, each of which has a Back-Surface-Field (BSF) for preventing electrons from entering the back electrode thereof. In recent years, there are noticed FERC (Passivated Emitter and Rear Cell) solar cells for further improving the efficiency by means of a passivation film (of SiN, $SiO_2$, $Al_2O_3$ or the like) for reducing the energy loss due to recombination occurring on the boundary surface between silicon and aluminum electrode of the back surface of each of the solar cells. In the production of such a PERC solar cell, the passivation film is easily damaged if the firing temperature of a silver powder is too high when the silver is used for a baked type conductive paste for forming an electrode.

For that reason, there is desired a silver powder, which can be sufficiently sintered to cause silver particles to be adhered to each other, even if the silver powder is heated at a lower temperature than that of a silver powder produced by the method of Patent Document 2.

It is therefore an object of the present invention to eliminate the aforementioned problems and to provide a spherical silver powder capable of being sintered at a lower temperature.

Means for Solving the Problem

In order to accomplish the aforementioned object, the inventors have diligently studied and found that it is possible to provide a spherical silver powder capable of being sintered at a lower temperature, if the spherical silver powder comprises: spherical silver particles; and cavities, each of which is formed in a corresponding one of the spherical silver particles, wherein each of the cavities has a major axis of 100 to 1000 nm and a minor axis of 10 nm or more, the ratio of the major axis to the minor axis (major axis/minor axis) being 5 or more, the major axis being the length of the long side of a rectangle which has a minimum area and which circumscribes the outline of a cross-section of a corresponding one of the cavities on an image of the cross-section of the corresponding one of the silver particles exposed by polishing the surface of a resin after the silver powder is embedded in the resin, and the minor axis being the length of the narrow side of the rectangle. Thus, the inventors have made the present invention.

According to the present invention, there is provided a spherical silver powder comprising: spherical silver particles; and cavities, each of which is formed in a corresponding one of the spherical silver particles, wherein each of the cavities has a major axis of 100 to 1000 nm and a minor axis of 10 nm or more, the ratio of the major axis to the minor axis (major axis/minor axis) being 5 or more, the major axis being the length of the long side of a rectangle which has a minimum area and which circumscribes the outline of a cross-section of a corresponding one of the cavities on an image of the cross-section of the corresponding one of the silver particles exposed by polishing the surface of a resin after the silver powder is embedded in the resin, and the minor axis being the length of the narrow side of the rectangle.

In this spherical silver powder, the percentage of a cross-sectional area of the cavities to a cross-sectional area of the silver particles is preferably 10% or less on the cross-section of the silver particles. The spherical silver powder preferably has an average particle diameter $D_{50}$ of 0.5 to 4.0 μm based on a laser diffraction method. The spherical silver powder preferably has a BET specific surface area of 0.1 to 1.5 $m^2/g$, and a specific surface area diameter $D_{BET}$ of 0.1 to 3 μm. The spherical silver powder preferably has an average primary particle diameter $D_{SEM}$ of 0.3 to 3 μm. The ratio ($D_{SEM}/D_{BET}$) of the average primary particle diameter $D_{SEM}$ to specific surface area diameter $D_{BET}$ of the spherical silver powder is preferably in the range of from 1.0 to 2.0. The shrinking percentage of the spherical silver powder preferably reaches 10% at a temperature of not higher than 360° C. when the spherical silver powder is heated. Each of the cavities is preferably a closed cavity which is not communicated with the outside. The spherical silver powder preferably contains an organic substance which has an amino group and a carboxyl group in a structure thereof and which has a cyclic structure. The organic substance preferably has a molecular weight of not less than 100.

Throughout the specification, the expression "shrinking percentage of a spherical silver powder when the spherical silver powder is heated" means a shrinking percentage of a pellet when the temperature of the pellet is raised at a rate of temperature increase of 10° C./min. from a room temperature to 900° C. (a percentage of the reduced length of the pellet to a difference between the length of the pellet at the room temperature and the most contracted length of the pellet), the pellet being a substantially cylindrical pellet (having a diameter of 5 mm) produced by applying a load of 50 kgf for 1 minute to the spherical silver powder.

Effects of the Invention

According to the present invention, it is possible to provide a spherical silver powder capable being sintered at a lower temperature.

MODE FOR CARRYING OUT THE INVENTION

Figure 1:
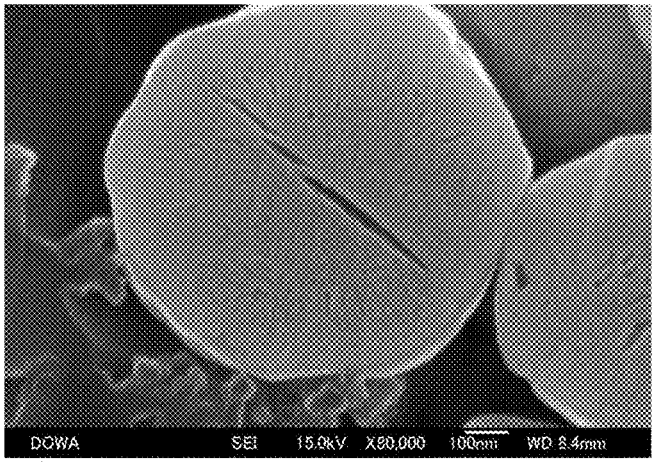
FIG. 1 is a field emission scanning electron microscope (FE-SEM) image of a cross-section of a spherical silver powder which is obtained in Example 1.

The preferred embodiment of a spherical silver powder according to the present invention, comprises: spherical silver particles; and cavities, each of which is formed in a corresponding one of the spherical silver particles, wherein each of the cavities has a major axis of 100 to 1000 nm (preferably 100 to 700 nm, more preferably 100 to 500 nm) and a minor axis of 10 nm or more (preferably 10 to 100 nm), the ratio of the major axis to the minor axis (major axis/minor axis) being 5 or more (preferably 10 or more), the major axis being the length of the long side of a rectangle which has a minimum area and which circumscribes the outline of a cross-section of a corresponding one of the cavities on an image of the cross-section of the corresponding one of the silver particles exposed by polishing the surface of a resin after the spherical silver powder is embedded in the resin, and the minor axis being the length of the narrow side of the rectangle.

Each of the cavities of the spherical silver powder is preferably a cavity extending in the vicinity of the center of a corresponding one of the silver particles of the spherical silver powder, and is preferably a closed cavity which is not communicated with the outside. On the cross-section of the silver particles of the spherical silver powder, the percentage of a cross-sectional area of the cavities to a cross-sectional area of the silver particles is preferably 0.05 to 10%, more preferably 0.05 to 5% and most preferably 0.1 to 3%.

The shape of the corresponding one of the particles of such a silver powder, and the presence of the corresponding one of the cavities in the corresponding one of the particles can be confirmed by observing a cross-section of the particles of the silver powder by means of an electron microscope (preferably at a magnification of 10,000 to 40,000), the cross-section being exposed by polishing the surface of a resin in a state that the silver powder is embedded in the resin. With respect to the cross-section of the particles of the spherical silver powder, the size of the cross-section in the central portion of a corresponding one of the particles of the spherical silver powder is different from the size of the cross-section in the vicinity of the edge portion of a corresponding one of the particles of the spherical silver powder. Among 50 particles of the spherical silver powder observed as the particles of the spherical silver powder having the exposed cross-section, 30 particles of the spherical silver powder are selected from the largest cross-section in order. If a cavity (the shape of the cavity having a major axis of 100 to 1000 nm and a minor axis of 10 nm or more, the ratio of the major axis to the minor axis (major axis/minor axis) being 5 or more) is observed on the cross-section of at least one particle of the spherical silver powder on the cross-section of the 30 particles of the spherical silver powder, it is assumed that the spherical silver is a spherical silver powder having at least one cavity (having the above-described shape) in the particle thereof.

Specifically, when the cross-section of the spherical silver powder is observed, the spherical silver powder is embedded in a resin, the surface of which is polished by means of a cross-section polisher to expose the cross-section of particles of the spherical silver powder to prepare a sample for observation of the cross-section of the spherical silver powder. This sample is observed (preferably at a magnification of 40,000 to 80,000) by means of an electron microscope to obtain an image. The image thus obtained is analyzed by means of an image analyzing software to obtain the size (major axis and minor axis) of a corresponding one of cavities on the cross-section of a corresponding one of the particles of the spherical silver powder, the percentage of the cross-sectional area of the cavities to the cross-sectional area of the particles of the spherical silver powder (the percentage of the total cross-sectional area of the cavities to the cross-sectional area of the particles of the spherical silver powder if the cross-section of the corresponding one of the particles of the spherical silver powder has a plurality of cavities), and the diameter of a circumscribed circle of the outline of the cross-section of the corresponding one of the particles of the spherical silver powder. Then, the average values thereof are calculated to be assumed as the major axis and minor axis of the cavities of the spherical silver powder, the percentage of the cross-sectional area of the cavities to the cross-sectional area of the particles of the spherical silver powder, and the average primary particle diameter $D_{SEM}$ of the spherical silver powder, respectively. The average primary particle diameter $D_{SEM}$ of the spherical silver powder is preferably 0.3 to 3 μm, and more preferably 0.5 to 2 μm.

The average particle diameter $D_{50}$ of the spherical silver powder based on a laser diffraction method (the particle diameter $D_{50}$ corresponding to 50% of accumulation in volume-based cumulative distribution of the spherical silver powder, which is measured by means of a laser diffraction particle size analyzer) is preferably 0.5 to 4.0 μm, and more preferably 1.1 to 3.5 μm. If the average particle diameter $D_{50}$ of the spherical silver powder based on the laser diffraction method is too large, it is difficult to describe fine wires when the spherical silver powder is used for using a conductive paste to describe wires or the like. On the other hand, if the average particle diameter $D_{50}$ of the spherical silver powder based on the laser diffraction method is too small, it is difficult to increase the concentration of silver in the conductive paste, so that there is same possibility that the wires or the like may be broken. Furthermore, in the volume-based particle diameter distribution of the spherical silver powder, the width of the peak is preferably narrow, and the variation in particle size is preferably small, so that the range of the particle size is preferably narrow.

The BET specific surface area of the spherical silver powder is preferably 0.1 to 1.5 $m^2/g$, and more preferably 0.2 to 1 $m^2/g$. If the BET specific surface area of the spherical silver powder is smaller than 0.1 $m^2/g$, the particles of the spherical silver powder are larger. If such a large spherical silver powder is used for preparing a conductive paste to describe wires or the like, it is difficult to describe fine wires. On the other hand, if the BET specific surface area of the spherical silver powder is larger than 1.5 $m^2/g$, the viscosity of the conductive paste is too high, so that it is required to dilute the conductive paste to be used. For that reason, the concentration of silver in the conductive paste is lower, so that there is some possibility that the wires or the like may be broken.

The particle diameter (the specific surface area diameter of the spherical silver powder) $D_{BET}$ (=6/(density of silver× BET specific surface area)) of the particles of the spherical silver powder is preferably 0.1 to 3 μm, and more preferably 0.5 to 1.5 μm. The specific surface area diameter $D_{BET}$ being calculated from the BET specific surface area assuming that the shape of each particle of the spherical silver powder is a true sphere.

The ratio ($D_{SEM}/D_{BET}$) of the average primary particle diameter $D_{SEM}$ to specific surface area diameter $D_{BET}$ of the spherical silver powder is preferably in the range of from 1.0 to 2.0. If this ratio is closer to 1, the spherical silver powder has a shape closer to that of a sphere.

The shrinking percentage of the spherical silver powder preferably reaches 10% at a temperature of not higher than 360° C., and more preferably reaches 10% at a temperature of not higher than 335° C., when the spherical silver powder is heated.

The spherical silver powder preferably contains an organic substance which has an amino group and a carboxyl group in a structure thereof. This organic substance preferably has a cyclic structure. The molecular weight of the organic substance is preferably not less than 100. The organic substance is more preferably an aromatic amino acid having a molecular weight of not less than 100, such as tyrosine, tryptophan, phenylalanine or anthranilic acid. The weight percentage of the organic substance in the spherical silver powder is preferably 0.001 to 2% by weight. This weight percentage can be analyzed by means of a liquid chromatography-mass spectrometer.

Such a spherical silver powder can be produced by depositing silver particles by reduction by adding a reducing agent to a water reaction system containing silver ions after adding an organic substance thereto, the organic substance having an amino group and a carboxyl group in a structure thereof and having a cyclic structure, the molecular weight of the organic substance being 100 or more.

As the water reaction system containing silver ions, an aqueous solution or slurry containing silver nitrate, a silver complex or a silver intermediate may be used. The aqueous solution containing a silver complex may be produced by adding aqueous ammonia or an ammonia salt to an aqueous silver nitrate solution or a suspension of silver oxide. Among them, an aqueous solution of silver ammine complex obtained by adding aqueous ammonia to an aqueous silver nitrate solution is preferably used in order to produce a silver powder having an appropriate particle size and a spherical shape. The coordination number of ammonia in the silver ammine complex is 2, so that 2 moles or more of ammonia per 1 mole of silver is added. If the amount of ammonia to be added is too large, the complex is too stable, so that it is difficult to proceed reduction. Therefore, the amount of ammonia to be added is preferably not larger than 8 moles per 1 mole of silver. Furthermore, if adjustment is carried out by increasing the amount of ammonia to be added or the like, even if the amount of ammonia to be added exceeds 8 moles, it is possible to obtain a spherical silver powder having an appropriate particle size. Furthermore, the water reaction system containing silver ions is preferably alkaline, and is preferably adjusted to be alkaline by adding an alkali, such as sodium hydroxide, as a pH adjuster thereto.

As the organic substance which has an amino group and a carboxyl group in a structure thereof and which has a cyclic structure and a molecular weight of not less than 100, there is preferably used an aromatic amino acid having a molecular weight of not less than 100, such as tyrosine, tryptophan, phenylalanine or anthranilic acid. It is considered that the organic substance can exist as ions in the reaction solution and that a cavity (the shape of the cavity having a major axis of 100 to 1000 nm and a minor axis of 10 nm or more, the ratio of the major axis to the minor axis (major axis/minor axis) being 5 or more) can be formed in a corresponding one of the particles of the spherical silver powder by the presence of the ions of the aromatic amino acid. If the molecular weight of the organic substance is less than 100, it is difficult to form a cavity (having the above-described shape) in the corresponding one of the silver particles when the reducing agent is added to the water reaction system containing silver ions to deposit the silver particles by reduction. The amount of the organic substance to be added is preferably 0.05 to 6% by weight, more preferably 0.1 to 5% by weight, and most preferably 0.2 to 4% by weight, with respect to silver. Furthermore, as this organic substance, a plurality of organic substances may be added.

As the reducing agent, there may be used a reducing agent comprising carbon, oxygen and hydrogen. For example, there may be used at least one of ascorbic acid, hydrogen peroxide water, formic acid, tartaric acid, hydroquinone, pyrogallol, glucose, gallic acid, formalin and so forth, and formalin is preferably used. If such a reducing agent is used, it is possible to obtain a spherical silver powder having the above-described particle diameter. The amount of the reducing agent to be added is preferably an equivalent of not less than 1 with respect to silver in order to enhance the yield of silver, and more preferably an equivalent of not less than 2 with respect to silver when a reducing agent having a weak reducing power is used. For example, it may be an equivalent of 10 to 20 with respect to silver.

The reducing agent is preferably added at a rate of an equivalent of not less than 1 per minute in order to prevent the spherical silver powder from being agglutinated. It is considered that the dispersability of the spherical silver powder is improved since the deposition of the silver particles by reduction is caused at a stroke to complete the reduction reaction in a short period of time to cause the produced nucleuses to be difficult to be agglutinated to each other if the reducing agent is added in the short period of time, although there is no clear reason. Therefore, the addition time of the reducing agent is preferably shorter, and the reaction solution is preferably stirred so as to complete the reaction in a shorter period of time during the reduction. The temperature during the reduction reaction is preferably 5 to 80° C., and more preferably 5 to 40° C. If the reaction temperature is lower, there are easily produced cavities (each of which has a major axis of 100 to 1000 nm and a minor axis of 10 nm or more, the ratio of the major axis to the minor axis (major axis/minor axis) being 5 or more) in the particles of the spherical silver powder. In order to produce the cavities (having the above-described shape) in the particles of the spherical silver powder, the reaction solution is preferably stirred before or while the reducing agent is added. After the silver particles are deposited by reduction by means of the reducing agent, a surface treatment agent may be added to cause the surface treatment agent to be adhered to the surface of the silver particles.

The silver containing slurry obtained by depositing the silver particles by reduction is preferably solid-liquid separated, and the solid body thus obtained is preferably washed with pure water to remove impurities therein. The terminal of washing can be determined by the electrical conductivity of water after washing.

Since the massive cake obtained after washing contains a large amount of water, a dried spherical silver powder is preferably obtained by means of a drier such as a vacuum drier. The drying temperature is preferably 100° C. or lower in order to prevent the spherical silver particles from being sintered to be adhered to each other during drying.

The silver powder thus obtained may be subjected to a dry-pulverizing and/or classification process. In place of the pulverizing, the spherical silver powder may be subjected to a surface smoothing process for smoothing the irregularities and angular portions on the surface of the particles of the spherical silver powder by putting the spherical silver powder into an apparatus, which is capable of mechanically fluidizing particles, to mechanically cause the particles of the spherical silver powder to collide with each other. After the pulverizing or surface smoothing process is carried out, a classification process may be carried out. The drying, pulverizing and classification processes may be carried out by means of an integrated apparatus capable of carrying out the drying, pulverizing and classification processes.

EXAMPLES

Examples of a spherical silver powder according to the present invention will be described below in detail.

Example 1

First, 155 g of an aqueous ammonia solution having a concentration of 28% by weight was added to 3500 g of an aqueous silver nitrate solution containing 0.12 mol/L of silver ions to form a silver ammine complex solution. The pH of the silver ammine complex solution was adjusted by adding 5.5 g of an aqueous sodium hydroxide solution having a concentration of 20% by weight thereto. Then, 4.2 g of an aqueous solution containing 10% by weight of L-tryptophan having a molecular weight of 204 was added to the pH-adjusted silver ammine complex solution. Thereafter, while the solution was stirred at a constant temperature of 20° C., 380 g of an aqueous formalin solution having a concentration of 23% by weight serving as a reducing agent was added thereto. The solution was further sufficiently stirred to obtain a slurry containing silver particles. After an aqueous solution containing 15% by weight of stearic acid serving as a surface treatment agent was added to the slurry to sufficiently stir the slurry, the ageing thereof was carried out. After the slurry thus aged was filtered, the solid body thus obtained was washed with water to be dried to be pulverized to obtain a silver powder.

After the silver powder thus obtained was embedded in a resin, the cross-section of particles of the silver powder was exposed by polishing the surface of the resin by means of a cross-section polisher (IB-09010CP produced by JEOL Ltd.), to prepare a sample for observing the cross-section of the silver powder. This sample was observed at a magnification of 10,000 by means of a field emission scanning electron microscope (FE-SEM) (JSM-6700F produced by JEOL Ltd.) to obtain an image of the cross-section of 50 particles or more of the silver powder. It was confirmed from this image that the shape of the silver powder was spherical and that cavities existed on the cross-sections of 10 particles among 30 particles having larger cross-sections. The diameter of a circumscribed circle of the outline of the cross-section of each of the particles of the spherical silver powder on the image was obtained to calculate an average value of the diameters of the particles of the spherical silver powder to obtain an average value (average primary particle diameter) $D_{SEM}$ of the diameters of circumscribed circles of the outlines of the cross-sections of the particles of the spherical silver powder. As a result, the average primary particle diameter $D_{SEM}$ was 1.0 μm. Furthermore, FIG. 1 shows an electron microscope image obtained by observing the particles of the spherical silver powder at a magnification of 80,000, the particles being confirmed to have the cavities.

The image thus obtained was analyzed by means of an image analyzing software (Mac-View produced by Mountech Co., Ltd.) to obtain the size of each of cavities on the cross-section of particles of the spherical silver powder, and the percentage of the cross-sectional area of the cavities to the cross-sectional area of the particles of the spherical silver powder (the percentage of the total cross-sectional area of the cavities to the cross-sectional area of the particles of the spherical silver powder if the cross-section of the particles of the spherical silver powder had a plurality of cavities). Furthermore, the used image analyzing software is designed that, if the outline of each of cavities on the image of the cross-section thereof was traced by means of a touch pen, there can be calculated the cross-sectional area of a corresponding one of the cavities, the major axis (being the length of the long side of a rectangle (or square) which has a minimum area and which circumscribes the outline of the cross-section of the corresponding one of the cavities) and the minor axis (being the length of the narrow side of the rectangle). As a result, it was confirmed that three cavities existed on the cross-section of the particles of the spherical silver powder on the image. The major axis of each of the three cavities, the minor axis thereof, and the ratio (aspect ratio) of the major axis to minor axis thereof were 437 nm, 34.2 nm and 12.80; 160 nm, 26.6 nm and 6.02; and 218 nm, 24.6 nm and 8.84, respectively. The percentage of the cross-sectional area of a corresponding one of the three cavities to the cross-sectional area of a corresponding one of the particles of the spherical silver powder were 1.28%, 0.36% and 0.36%, respectively, and the total percentage thereof was 2.00%.

The BET specific surface area of the obtained spherical silver powder was measured by the single point BET method by means of a BET specific surface area measuring apparatus (Monosorb HM-model 1210 produced by Mountech Co. Ltd.) after the interior of the measuring apparatus was degassed by causing an Ne—$N_2$ mixed gas (nitrogen: 30%) to flow therein at 60° C. for 10 minutes. As a result, the BET specific surface area was 0.70 $m^2/g$. The particle diameter (specific surface area diameter) $D_{BET}$ of the particles of the spherical silver powder was calculated from $D_{BET}$=6/(density of silver×BET specific surface area), the specific surface area diameter $D_{BET}$ being calculated from the BET specific surface area assuming that the shape of each of the particles of the spherical silver powder was a true sphere. As a result, the specific surface area diameter $D_{BET}$ was 0.8 μm, and the ratio ($D_{SEM}/D_{BET}$) was 1.3.

The particle diameter distribution of the obtained spherical silver powder was measured by means of a laser diffraction particle size analyzer (Microtrac Particle Size Analyzer MT-3300EX11 produced by Microtrac BEL Corporation), to obtain a particle diameter ($D_{50}$) corresponding to 50% of accumulation in volume-based cumulative distribution of the spherical silver powder. As a result, the particle diameter ($D_{50}$) was 1.7 μm.

A pellet forming apparatus was used for applying a load of 50 kgf for 1 minute to the obtained spherical silver powder to prepare a substantially cylindrical pellet (having a diameter of 5 mm). This pellet was set in a thermomechanical analyzing (TMA) apparatus (TMA8311 produced by Rigaku Corporation) to raise the temperature of the pellet at a rate of temperature increase of 10° C./min. from a room temperature to 900° C. to measure a shrinking percentage of the pellet (a percentage of the reduced length c of the pellet to a difference (a−b) between the length a of the pellet at the room temperature and the most contracted length b of the pellet) (=c×100/(a−b)). Assuming that a sintering starting temperature was a temperature at which the shrinking percentage of the pellet reached 10%, the sintering starting temperature of the spherical silver powder was 305° C.

Then, 10 mL of an aqueous nitric acid solution prepared by mixing nitric acid (for precision analysis produced by Kanto Chemical Co., Inc. (60-61%)) and pure water in a volume ratio of 1:1 was added to 1.0 g of the obtained spherical silver powder to completely dissolve the spherical silver powder therein with ultrasonic waves. The solution thus obtained was diluted with ultrapure water ten thousand times to be analyzed by means of a liquid chromatography-mass spectrometer (LC/MC) (Agilent 6470 Triple Quadrupole LC/MS (minimum limit of detection: 0.1 ppm) produced by Agilent Technologies Co., Ltd.). As a result, 0.12% by weight of tryptophan (nitrogenized with nitric acid) was detected from the spherical silver powder.

Example 2

First, 155 g of an aqueous ammonia solution having a concentration of 28% by weight was added to 3500 g of an aqueous silver nitrate solution containing 0.12 mol/L of silver ions to form a silver ammine complex solution. The pH of the silver ammine complex solution was adjusted by adding 5.5 g of an aqueous sodium hydroxide solution having a concentration of 20% by weight thereto. Then, 14 g of an aqueous solution containing 2.4% by weight of L-phenylalanine having a molecular weight of 165 was added to the pH-adjusted silver ammine complex solution. Thereafter, while the solution was stirred at a constant temperature of 20° C., 380 g of an aqueous formalin solution having a concentration of 23% by weight serving as a reducing agent was added thereto. The solution was further sufficiently stirred to obtain a slurry containing silver particles. After an aqueous solution containing 15% by weight of stearic acid serving as a surface treatment agent was added to the slurry to sufficiently stir the slurry, the ageing thereof was carried out. After the slurry thus aged was filtered, the solid body thus obtained was washed with water to be dried to be pulverized to obtain a silver powder.

Figure 2:
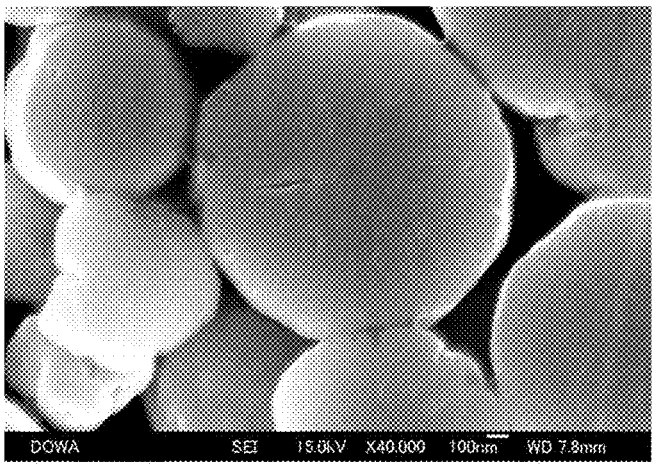
FIG. 2 is an FE-SEM image of a cross-section of a spherical silver powder which is obtained in Example 2.

With respect to the silver powder thus obtained, it was confirmed from the image of the cross-section of the particles of the silver powder observed at a magnification of 10,000 by the same method as that in Example 1 that the shape of the silver powder was spherical and that cavities existed on the cross-sections of 2 particles among 30 particles having larger cross-sections. FIG. 2 shows an electron microscope image obtained by observing the particles of the spherical silver powder at a magnification of 40,000, the particles being confirmed to have the cavities. With respect to the obtained image, the size of the cavities on the cross-section of the particles of the spherical silver powder, the percentage of the cross-sectional area of the cavities to the cross-sectional area of the particles of the spherical silver powder, and the average primary particle diameter $D_{SEM}$ of the spherical silver powder, were obtained by the same methods as those in Example 1. As a result, it was confirmed that one cavity existed on the cross-section of the particles of the spherical silver powder on the image. The major axis of the cavity, the minor axis thereof, and the aspect ratio (major axis/minor axis) thereof were 416 nm, 32.6 nm and 12.75, respectively. The percentage of the cross-sectional area of the cavity to the percentage of the cross-sectional area of the particles of the spherical silver powder was 0.33%, and the average primary particle diameter $D_{SEM}$ of the spherical silver powder was 1.4 μm.

With respect to the obtained spherical silver powder, the BET specific surface area was measured by the same method as that in Example 1, and the specific surface area diameter $D_{BET}$ was obtained by the same method as that in Example 1. In addition, the particle diameter ($D_{50}$) corresponding to 50% of accumulation in volume-based cumulative distribution of the spherical silver powder was obtained by the same method as that in Example 1. As a result, the BET specific surface area was 0.72 $m^2/g$, and the specific surface area diameter $D_{BET}$ was 0.8 μm. The ratio ($D_{SEM}/D_{BET}$) was 1.8, and the particle diameter ($D_{50}$) was 1.4 μm.

With respect to the obtained spherical silver powder, the sintering starting temperature was obtained by the same method as that in Example 1. As a result, the sintering starting temperature was 306° C.

The obtained spherical silver powder was analyzed by means of a liquid chromatography-mass spectrometer by the same method as that in Example 1. As a result, 0.23% by weight of phenylalanine was detected from the spherical silver powder.

Example 3

First, 155 g of an aqueous ammonia solution having a concentration of 28% by weight was added to 3200 g of an aqueous silver nitrate solution containing 0.12 mol/L of silver ions to form a silver ammine complex solution. The pH of the silver ammine complex solution was adjusted by adding 5.5 g of an aqueous sodium hydroxide solution having a concentration of 20% by weight thereto. Then, 300 g of an aqueous solution containing 0.12% by weight of tyrosine having a molecular weight of 181.19 was added to the pH-adjusted silver ammine complex solution. Thereafter, while the solution was stirred at a circumferential speed of 100 m/s of an impeller at a constant temperature of 20° C., 380 g of an aqueous formalin solution having a concentration of 23% by weight serving as a reducing agent was added thereto. The solution was further sufficiently stirred to obtain a slurry containing silver particles. After an aqueous solution containing 15% by weight of stearic acid serving as a surface treatment agent was added to the slurry to sufficiently stir the slurry, the ageing thereof was carried out. After the slurry thus aged was filtered, the solid body thus obtained was washed with water to be dried to be pulverized to obtain a silver powder.

Figure 3:
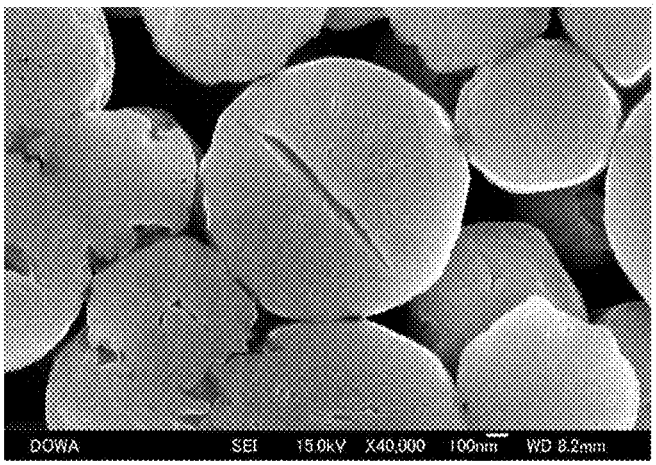
FIG. 3 is an FE-SEM image of a cross-section of a spherical silver powder which is obtained in Example 3.

With respect to the silver powder thus obtained, it was confirmed from the image of the cross-section of the particles of the silver powder observed at a magnification of 10,000 by the same method as that in Example 1 that the shape of the silver powder was spherical and that cavities existed on the cross-sections of 15 particles among 30 particles having larger cross-sections. FIG. 3 shows an electron microscope image obtained by observing the particles of the spherical silver powder at a magnification of 40,000, the particles being confirmed to have the cavities. With respect to the obtained image, the size of the cavities on the cross-section of the particles of the spherical silver powder, the percentage of the cross-sectional area of the cavities to the cross-sectional area of the particles of the spherical silver powder, and the average primary particle diameter $D_{SEM}$ of the spherical silver powder, were obtained by the same methods as those in Example 1. As a result, it was confirmed that one cavity existed on the cross-section of the particles of the spherical silver powder on the image. The major axis of the cavity, the minor axis thereof, and the aspect ratio (major axis/minor axis) thereof were 952 nm, 80.7 nm and 11.80, respectively. The percentage of the cross-sectional area of the cavity to the percentage of the cross-sectional area of the particles of the spherical silver powder was 2.53%, and the average primary particle diameter $D_{SEM}$ of the spherical silver powder was 1.2 μm.

With respect to the obtained spherical silver powder, the BET specific surface area was measured by the same method as that in Example 1, and the specific surface area diameter $D_{BET}$ was obtained by the same method as that in Example 1. In addition, the particle diameter ($D_{50}$) corresponding to 50% of accumulation in volume-based cumulative distribution of the spherical silver powder was obtained by the same method as that in Example 1. As a result, the BET specific surface area was 0.60 $m^2/g$, and the specific surface area diameter $D_{BET}$ was 1.0 μm. The ratio ($D_{SEM}/D_{BET}$) was 1.3, and the particle diameter ($D_5O$) was 1.7 μm.

With respect to the obtained spherical silver powder, the sintering starting temperature was obtained by the same method as that in Example 1. As a result, the sintering starting temperature was 311° C.

The obtained spherical silver powder was analyzed by means of a liquid chromatography-mass spectrometer by the same method as that in Example 1. As a result, 0.0012% by weight of tyrosine (nitrogenized with nitric acid) was detected from the spherical silver powder.

Example 4

First, 162 g of an aqueous ammonia solution having a concentration of 28% by weight was added to 3300 g of an aqueous silver nitrate solution containing 0.13 mol/L of silver ions to form a silver ammine complex solution. The pH of the silver ammine complex solution was adjusted by adding 5.86 g of an aqueous sodium hydroxide solution having a concentration of 20% by weight thereto. Then, 6.5 g of an aqueous solution containing 7% by weight of L-tryptophan having a molecular weight of 204 prepared by dissolving L-tryptophan in 6.09 g of an aqueous sodium hydroxide solution having a concentration of 2.0% by weight was added to the pH-adjusted silver ammine complex solution. Thereafter, while the solution was stirred at a circumferential speed of 100 m/s of an impeller at a constant temperature of 28 V, 375 g of an aqueous formalin solution having a concentration of 25% by weight serving as a reducing agent was added thereto. The solution was further sufficiently stirred to obtain a slurry containing silver particles. After an aqueous solution containing 15% by weight of stearic acid serving as a surface treatment agent was added to the slurry to sufficiently stir the slurry, the ageing thereof was carried out. After the slurry thus aged was filtered, the solid body thus obtained was washed with water to be dried to be pulverized to obtain a silver powder.

Figure 4:
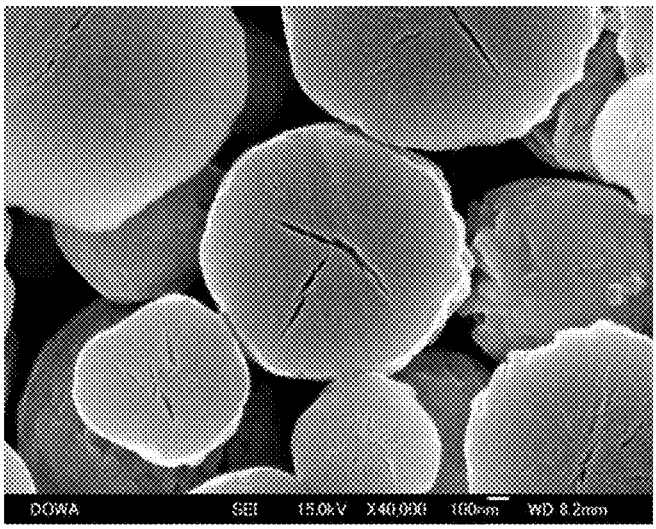
FIG. 4 is an FE-SEM image of a cross-section of a spherical silver powder which is obtained in Example 4.

With respect to the silver powder thus obtained, it was confirmed from the image of the cross-section of the particles of the silver powder observed at a magnification of 10,000 by the same method as that in Example 1 that the shape of the silver powder was spherical and that cavities existed on the cross-sections of 21 particles among 30 particles having larger cross-sections. FIG. 4 shows an electron microscope image obtained by observing the particles of the spherical silver powder at a magnification of 40,000, the particles being confirmed to have the cavities. With respect to the obtained image, the size of the cavities on the cross-section of the particles of the spherical silver powder, the percentage of the cross-sectional area of the cavities to the cross-sectional area of the particles of the spherical silver powder, and the average primary particle diameter $D_{SEM}$ of the spherical silver powder, were obtained by the same methods as those in Example 1. As a result, it was confirmed that four cavities existed on the cross-section of the particles of the spherical silver powder on the image. The major axis of each of the four cavities, the minor axis thereof, and the aspect ratio (major axis/minor axis) thereof were 751 nm, 126 nm and 5.94; 270 nm, 37.7 nm and 7.15; 271 nm, 26.4 nm and 10.28; and 133 nm, 21.2 nm and 6.29, respectively. The percentage of the cross-sectional area of a corresponding one of the four cavities to the cross-sectional area of a corresponding one of the particles of the spherical silver powder were 1.83%, 0.48%, 0.40% and 0.15%, respectively (total percentage: 2.86%). The average primary particle diameter $D_{SEM}$ of the spherical silver powder was 1.49 μm.

With respect to the obtained spherical silver powder, the BET specific surface area was measured by the same method as that in Example 1, and the specific surface area diameter $D_{BET}$ was obtained by the same method as that in Example 1. In addition, the particle diameter ($D_{50}$) corresponding to 50% of accumulation in volume-based cumulative distribution of the spherical silver powder was obtained by the same method as that in Example 1. As a result, the BET specific surface area was 0.62 $m^2/g$, and the specific surface area diameter $D_{BET}$ was 0.9 μm. The ratio ($D_{SEM}/D_{BET}$) was 1.6, and the particle diameter ($D_{50}$) was 1.9 μm.

With respect to the obtained spherical silver powder, the sintering starting temperature was obtained by the same method as that in Example 1. As a result, the sintering starting temperature was 333° C.

Example 5

First, 162 g of an aqueous ammonia solution having a concentration of 28% by weight was added to 3300 g of an aqueous silver nitrate solution containing 0.13 mol/L of silver ions to form a silver ammine complex solution. The pH of the silver ammine complex solution was adjusted by adding 6.79 g of an aqueous sodium hydroxide solution having a concentration of 20% by weight thereto. Then, 2.2 g of an aqueous solution containing 7% by weight of L-tryptophan having a molecular weight of 204 prepared by dissolving L-tryptophan in 2.03 g of an aqueous sodium hydroxide solution having a concentration of 2.0% by weight was added to the pH-adjusted silver ammine complex solution. Thereafter, while the solution was stirred at a circumferential speed of 100 m/s of an impeller at a constant temperature of 28° C., 375 g of an aqueous formalin solution having a concentration of 25% by weight serving as a reducing agent was added thereto. The solution was further sufficiently stirred to obtain a slurry containing silver particles. After an aqueous solution containing 15% by weight of stearic acid serving as a surface treatment agent was added to the slurry to sufficiently stir the slurry, the ageing thereof was carried out. After the slurry thus aged was filtered, the solid body thus obtained was washed with water to be dried to be pulverized to obtain a silver powder.

Figure 5:
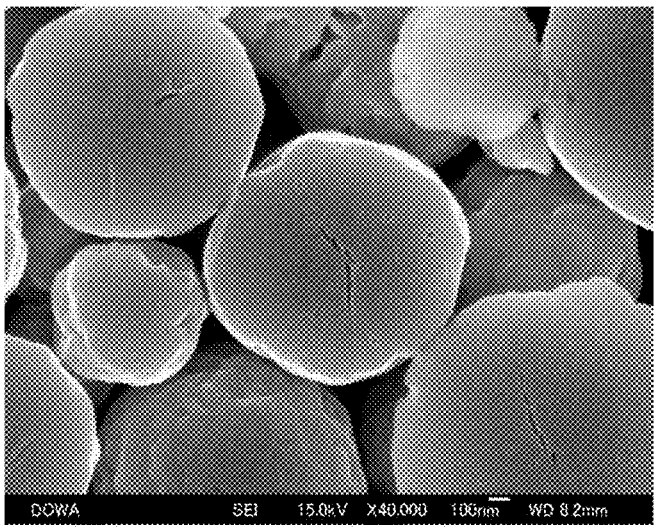
FIG. 5 is an FE-SEM image of a cross-section of a spherical silver powder which is obtained in Example 5.

With respect to the silver powder thus obtained, it was confirmed from the image of the cross-section of the particles of the silver powder observed at a magnification of 10,000 by the same method as that in Example 1 that the shape of the silver powder was spherical and that cavities existed on the cross-sections of 7 particles among 30 particles having larger cross-sections. FIG. 5 shows an electron microscope image obtained by observing the particles of the spherical silver powder at a magnification of 40,000, the particles being confirmed to have the cavities. With respect to the obtained image, the size of the cavities on the cross-section of the particles of the spherical silver powder, the percentage of the cross-sectional area of the cavities to the cross-sectional area of the particles of the spherical silver powder, and the average primary particle diameter $D_{SEM}$ of the spherical silver powder, were obtained by the same methods as those in Example 1. As a result, it was confirmed that two cavities existed on the cross-section of the particles of the spherical silver powder on the image. The major axis of each of the two cavities, the minor axis thereof, and the aspect ratio (major axis/minor axis) thereof were 188 nm, 36.2 nm and 5.18; and 277 nm, 34.9 nm and 7.93, respectively. The percentage of the cross-sectional area of a corresponding one of the two cavities to the cross-sectional area of a corresponding one of the particles of the spherical silver powder were 0.31%, 0.39%, respectively (total percentage: 0.70%). The average primary particle diameter $D_{SEM}$ of the spherical silver powder was 1.45 μm.

With respect to the obtained spherical silver powder, the BET specific surface area was measured by the same method as that in Example 1, and the specific surface area diameter $D_{BET}$ was obtained by the same method as that in Example 1. In addition, the particle diameter ($D_{50}$) corresponding to 50% of accumulation in volume-based cumulative distribution of the spherical silver powder was obtained by the same method as that in Example 1. As a result, the BET specific surface area was 0.58 $m^2/g$, and the specific surface area diameter $D_{BET}$ was 1.0 μm. The ratio ($D_{SEM}/D_{BET}$) was 1.5, and the particle diameter ($D_{50}$) was 1.7 μm.

With respect to the obtained spherical silver powder, the sintering starting temperature was obtained by the same method as that in Example 1. As a result, the sintering starting temperature was 331° C.

Example 6

First, 172 g of an aqueous ammonia solution having a concentration of 28% by weight was added to 3300 g of an aqueous silver nitrate solution containing 0.12 mol/L of silver ions to form a silver ammine complex solution. The pH of the silver ammine complex solution was adjusted by adding 5.3 g of an aqueous sodium hydroxide solution having a concentration of 20% by weight thereto. Then, 5.98 g of an aqueous solution containing 7% by weight of L-tryptophan having a molecular weight of 204 prepared by dissolving L-tryptophan in 5.56 g of an aqueous sodium hydroxide solution having a concentration of 2.0% by weight was added to the pH-adjusted silver ammine complex solution. Thereafter, while the solution was stirred at a circumferential speed of 100 m/s of an impeller at a constant temperature of 40° C., 433 g of an aqueous formalin solution having a concentration of 21% by weight serving as a reducing agent was added thereto. The solution was further sufficiently stirred to obtain a slurry containing silver particles. After an aqueous solution containing 13% by weight of oleic acid serving as a surface treatment agent was added to the slurry to sufficiently stir the slurry, the ageing thereof was carried out. After the slurry thus aged was filtered, the solid body thus obtained was washed with water to be dried to be pulverized to obtain a silver powder.

Figure 6:
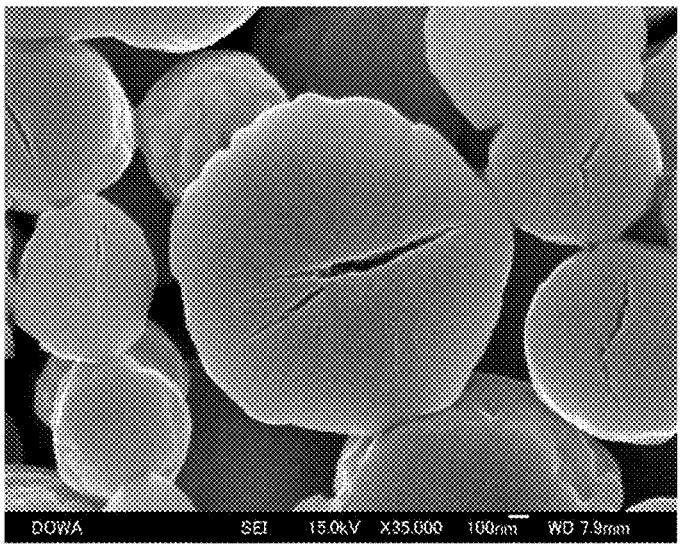
FIG. 6 is an FE-SEM image of a cross-section of a spherical silver powder which is obtained in Example 6.

With respect to the silver powder thus obtained, it was confirmed from the image of the cross-section of the particles of the silver powder observed at a magnification of 10,000 by the same method as that in Example 1 that the shape of the silver powder was spherical and that cavities existed on the cross-sections of 11 particles among 30 particles having larger cross-sections. FIG. 6 shows an electron microscope image obtained by observing the particles of the spherical silver powder at a magnification of 40,000, the particles being confirmed to have the cavities. With respect to the obtained image, the size of the cavities on the cross-section of the particles of the spherical silver powder, the percentage of the cross-sectional area of the cavities to the cross-sectional area of the particles of the spherical silver powder, and the average primary particle diameter $D_{SEM}$ of the spherical silver powder, were obtained by the same methods as those in Example 1. As a result, it was confirmed that four cavities existed on the cross-section of the particles of the spherical silver powder on the image. The major axis of each of the four cavities, the minor axis thereof, and the aspect ratio (major axis/minor axis) thereof were 1111 nm, 104 nm and 10.69; 250 nm, 36.7 nm and 6.82; 139 nm, 26.1 nm and 5.31; and 234 nm, 32.6 nm and 7.16, respectively. The percentage of the cross-sectional area of a corresponding one of the four cavities to the cross-sectional area of a corresponding one of the particles of the spherical silver powder were 2.11%, 0.24%, 0.07% and 0.16%, respectively (total percentage: 2.58%). The average primary particle diameter $D_{SEM}$ of the spherical silver powder was 1.64 μm.

With respect to the obtained spherical silver powder, the BET specific surface area was measured by the same method as that in Example 1, and the specific surface area diameter $D_{BET}$ was obtained by the same method as that in Example 1. In addition, the particle diameter ($D_{50}$) corresponding to 50% of accumulation in volume-based cumulative distribution of the spherical silver powder was obtained by the same method as that in Example 1. As a result, the BET specific surface area was 0.51 $m^2/g$, and the specific surface area diameter $D_{BET}$ was 1.1 μm. The ratio ($D_{SEM}/D_{BET}$) was 1.5, and the particle diameter ($D_{50}$) was 2.4 μm.

With respect to the obtained spherical silver powder, the sintering starting temperature was obtained by the same method as that in Example 1. As a result, the sintering starting temperature was 354° C.

Example 7

First, 150 g of an aqueous ammonia solution having a concentration of 28% by weight was added to 3300 g of an aqueous silver nitrate solution containing 0.12 mol/L of silver ions to form a silver ammine complex solution. The pH of the silver ammine complex solution was adjusted by adding 6.2 g of an aqueous sodium hydroxide solution having a concentration of 20% by weight thereto. Then, 5.98 g of an aqueous solution containing 7% by weight of L-tryptophan having a molecular weight of 204 prepared by dissolving L-tryptophan in 5.56 g of an aqueous sodium hydroxide solution having a concentration of 2.0% by weight was added to the pH-adjusted silver ammine complex solution. Thereafter, while the solution was stirred at a circumferential speed of 100 m/s of an impeller at a constant temperature of 20° C., 433 g of an aqueous formalin solution having a concentration of 21% by weight serving as a reducing agent was added thereto. The solution was further sufficiently stirred to obtain a slurry containing silver particles. After an aqueous solution containing 2% by weight of benzotriazole serving as a surface treatment agent was added to the slurry to sufficiently stir the slurry, the ageing thereof was carried out. After the slurry thus aged was filtered, the solid body thus obtained was washed with water to be dried to be pulverized to obtain a silver powder.

Figure 7:
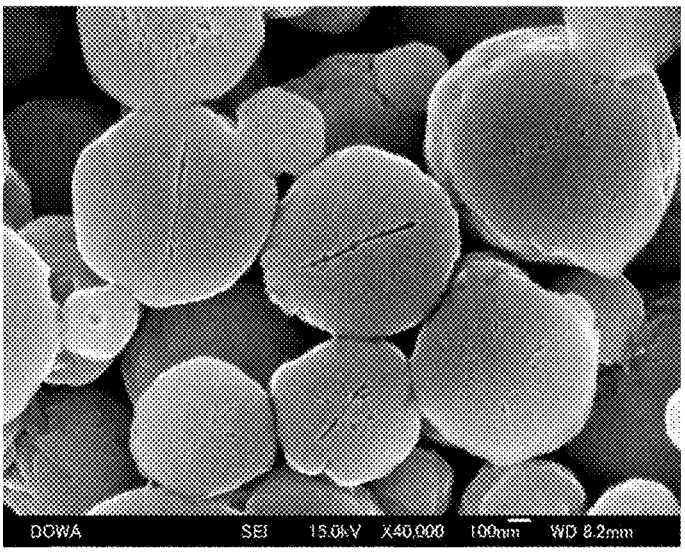
FIG. 7 is an FE-SEM image of a cross-section of a spherical silver powder which is obtained in Example 7.

With respect to the silver powder thus obtained, it was confirmed from the image of the cross-section of the particles of the silver powder observed at a magnification of 10,000 by the same method as that in Example 1 that the shape of the silver powder was spherical and that cavities existed on the cross-sections of 9 particles among 30 particles having large cross-sections. FIG. 7 shows an electron microscope image obtained by observing the particles of the spherical silver powder at a magnification of 40,000, the particles being confirmed to have the cavities. With respect to the obtained image, the size of the cavities on the cross-section of the particles of the spherical silver powder, the percentage of the cross-sectional area of the cavities to the cross-sectional area of the particles of the spherical silver powder, and the average primary particle diameter $D_{SEM}$ of the spherical silver powder, were obtained by the same methods as those in Example 1. As a result, it was confirmed that one cavity existed on the cross-section of the particles of the spherical silver powder on the image. The major axis of the cavity, the minor axis thereof, and the aspect ratio (major axis/minor axis) thereof were 571 nm, 39.4 nm and 14.51, respectively. The percentage of the cross-sectional area of the cavity to the cross-sectional area of the particle of the spherical silver powder was 2.05%. The average primary particle diameter $D_{SEM}$ of the spherical silver powder was 1.05 μm.

With respect to the obtained spherical silver powder, the BET specific surface area was measured by the same method as that in Example 1, and the specific surface area diameter $D_{BET}$ was obtained by the same method as that in Example 1. In addition, the particle diameter ($D_{50}$) corresponding to 50% of accumulation in volume-based cumulative distribution of the spherical silver powder was obtained by the same method as that in Example 1. As a result, the BET specific surface area was 1.05 $m^2/g$, and the specific surface area diameter $D_{BET}$ was 0.5 μm. The ratio ($D_{SEM}/D_{BET}$) was 1.9, and the particle diameter ($D_{50}$) was 1.3 μm.

With respect to the obtained spherical silver powder, the sintering starting temperature was obtained by the same method as that in Example 1. As a result, the sintering starting temperature was 346° C.

Example 8

First, 155 g of an aqueous ammonia solution having a concentration of 28% by weight was added to 3200 g of an aqueous silver nitrate solution containing 0.12 mol/L of silver ions to form a silver ammine complex solution. The pH of the silver ammine complex solution was adjusted by adding 5.1 g of an aqueous sodium hydroxide solution having a concentration of 20% by weight thereto. Then, 6 g of an aqueous solution containing 4.65% by weight of anthranilic acid having a molecular weight of 137.14 prepared by dissolving anthranilic acid in 5.755 g of an aqueous sodium hydroxide solution having a concentration of 1.5% by weight was added to the pH-adjusted silver ammine complex solution. Thereafter, while the solution was stirred at a circumferential speed of 100 m/s of an impeller at a constant temperature of 20° C., 380 g of an aqueous formalin solution having a concentration of 23% by weight serving as a reducing agent was added thereto. The solution was further sufficiently stirred to obtain a slurry containing silver particles. After an aqueous solution containing 15% by weight of stearic acid serving as a surface treatment agent was added to the slurry to sufficiently stir the slurry, the ageing thereof was carried out. After the slurry thus aged was filtered, the solid body thus obtained was washed with water to be dried to be pulverized to obtain a silver powder.

Figure 8:
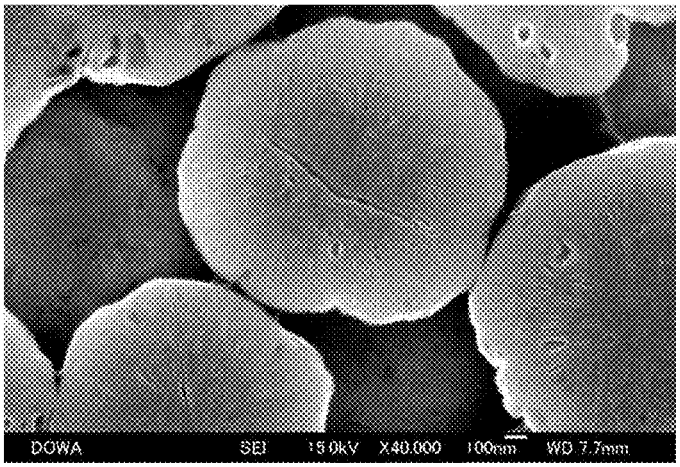
FIG. 8 is an FE-SEM image of a cross-section of a spherical silver powder which is obtained in Example 8.

With respect to the silver powder thus obtained, it was confirmed from the image of the cross-section of the particles of the silver powder observed at a magnification of 10,000 by the same method as that in Example 1 that the shape of the silver powder was spherical and that cavities existed on the cross-sections of 3 particles among 30 particles having larger cross-sections. FIG. 8 shows an electron microscope image obtained by observing the particles of the spherical silver powder at a magnification of 40,000, the particles being confirmed to have the cavities. With respect to the obtained image, the size of the cavities on the cross-section of the particles of the spherical silver powder, the percentage of the cross-sectional area of the cavities to the cross-sectional area of the particles of the spherical silver powder, and the average primary particle diameter $D_{SEM}$ of the spherical silver powder, were obtained by the same methods as those in Example 1. As a result, it was confirmed that one cavity existed on the cross-section of the particles of the spherical silver powder on the image. The major axis of the cavity, the minor axis thereof, and the aspect ratio (major axis/minor axis) thereof were 903 nm, 86.9 nm and 10.39, respectively. The percentage of the cross-sectional area of the cavity to the cross-sectional area of a corresponding one of the particles of the spherical silver powder was 1.23%. The average primary particle diameter $D_{SEM}$ of the spherical silver powder was 1.40 μm.

With respect to the obtained spherical silver powder, the BET specific surface area was measured by the same method as that in Example 1, and the specific surface area diameter $D_{BET}$ was obtained by the same method as that in Example 1. In addition, the particle diameter ($D_{50}$) corresponding to 50% of accumulation in volume-based cumulative distribution of the spherical silver powder was obtained by the same method as that in Example 1. As a result, the BET specific surface area was 0.72 $m^2/g$, and the specific surface area diameter $D_{BET}$ was 0.8 μm. The ratio ($D_{SEM}/D_{BET}$) was 1.8, and the particle diameter ($D_{50}$) was 1.7 μm.

With respect to the obtained spherical silver powder, the sintering starting temperature was obtained by the same method as that in Example 1. As a result, the sintering starting temperature was 312° C.

The obtained spherical silver powder was analyzed by means of a liquid chromatography-mass spectrometer by the same method as that in Example 1. As a result, 0.097% by weight of anthranilic acid (nitrogenized with nitric acid) was detected from the spherical silver powder.

Comparative Example 1

First, 753 g of an aqueous silver nitrate solution containing 8.63 g of silver was distributed into a 1 L beaker. Then, the beaker was put in an ultrasonic washing machine (US Cleaner USD-4R produced by AS ONE CORPORATION, Output 160 W) containing water having a temperature of 35° C. therein. Then, the solution in the beaker was started to be irradiated with ultrasonic waves at an oscillating frequency of 40 kHz and to be stirred.

Then, 29.1 g of an aqueous solution containing 28% by weight of ammonia (the equivalent thereof corresponding to 3.0 with respect to silver) was added to the aqueous silver nitrate solution in the beaker to form a silver ammine complex. After 30 seconds from the addition of the aqueous ammonia, 0.48 g of an aqueous solution containing 20% by weight of sodium hydroxide was added thereto. After 20 minutes from the addition of the aqueous ammonia, 48.7 g of an aqueous solution containing 27.4% by weight of formaldehyde (the equivalent thereof corresponding to 11.1 with respect to silver) prepared by diluting formalin with pure water was added thereto. After 30 seconds from the addition of the aqueous formaldehyde solution, 0.86 g of an ethanol solution containing 1.2% by weight of stearic acid was added thereto to form a slurry containing silver particles.

Then, after the irradiation with ultrasonic waves was completed, the slurry containing silver particles was filtrated, and the solid body thus obtained was washed with water. The cake thus obtained was dried at 75° C. for 10 hours by means of a vacuum drier. The silver powder thus dried was pulverized for 30 seconds by means of a coffee mill to obtain a spherical silver powder.

Figure 9:
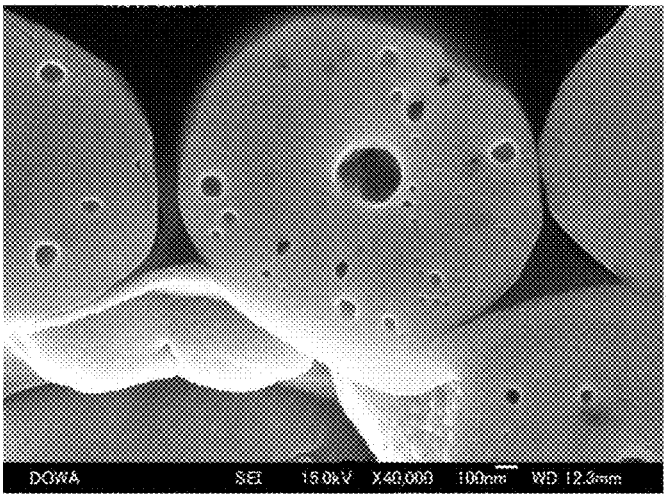
FIG. 9 is an FE-SEM image of a cross-section of a spherical silver powder which is obtained in Comparative Example 1.

With respect to the silver powder thus obtained, it was confirmed from the image of the cross-section of the particles of the silver powder observed at a magnification of 10,000 by the same method as that in Example 1 that the shape of the silver powder was spherical and that the silver powder had spherical cavities, not cavities, each of which had a major axis of 100 to 1000 nm and a minor axis of 10 nm or more, the ratio of the major axis to the minor axis (major axis/minor axis) being 5 or more. FIG. 9 shows an electron microscope image obtained by observing the particles of the spherical silver powder at a magnification of 40,000, the particles being confirmed to have the spherical cavities. With respect to the obtained image, the average primary particle diameter $D_{SEM}$ of the spherical silver powder was obtained by the same method as that in Example 1. As a result, The average primary particle diameter $D_{SEM}$ was 1.6 μm.

With respect to the obtained spherical silver powder, the BET specific surface area was measured by the same method as that in Example 1, and the specific surface area diameter $D_{BET}$ was obtained by the same method as that in Example 1. In addition, the particle diameter ($D_{50}$) corresponding to 50% of accumulation in volume-based cumulative distribution of the spherical silver powder was obtained by the same method as that in Example 1. As a result, the BET specific surface area was 0.35 $m^2/g$, and the specific surface area diameter $D_{BET}$ was 1.6 μm. The ratio ($D_{SEM}/D_{BET}$) was 1.0, and the particle diameter ($D_{50}$) was 3.0 μm. With respect to the obtained spherical silver powder, the sintering starting temperature was obtained by the same method as that in Example 1. As a result, the sintering starting temperature was 410° C.

Comparative Example 2

First, 28.6 g of an aqueous silver nitrate solution containing 8.63 g of silver was distributed into a 1 L beaker. Then, the beaker was put in an ultrasonic washing machine (US Cleaner USD-4R produced by AS ONE CORPORATION, Output 160 W) containing water having a temperature of 35° C. therein. Then, the solution in the beaker was started to be irradiated with ultrasonic waves at an oscillating frequency of 40 kHz, and to be stirred.

Then, 52.7 g of an aqueous solution containing 28% by weight of ammonia (the equivalent thereof corresponding to 5.0 with respect to silver) was added to the aqueous silver nitrate solution in the beaker to form a silver ammine complex. After 5 minutes from the addition of the aqueous ammonia, 2.2 g of an aqueous solution containing 0.40% by weight of polyethylene imine (having a molecular weight of 10,000) was added thereto. After 20 minutes from the addition of the aqueous ammonia, 19.4 g of an aqueous solution containing 6.2% by weight of hydrazine hydrate (the equivalent thereof corresponding to 1.2 with respect to silver) was added thereto. After 30 seconds from the addition of the aqueous solution of hydrazine hydrate, 0.77 g of a solution containing 1.3% by weight of stearic acid was added thereto to form a slurry containing silver particles. Furthermore, in this comparative example, polyethylene imine was added for adjusting the particle size which was decreased by the use of hydrazine.

Then, after the irradiation with ultrasonic waves was completed, the slurry containing silver particles was filtrated, and the solid body thus obtained was washed with water. The cake thus obtained was dried at 75° C. for 10 hours by means of a vacuum drier. The silver powder thus dried was pulverized for 30 seconds by means of a coffee mill to obtain a spherical silver powder.

Figure 10:
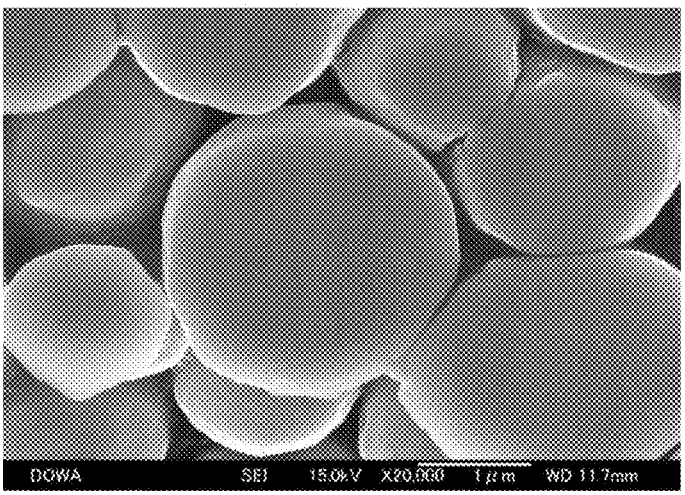
FIG. 10 is an FE-SEM image of a cross-section of a spherical silver powder which is obtained in Comparative Example 2.

With respect to the silver powder thus obtained, it was confirmed from the image of the cross-section of the particles of the silver powder observed at a magnification of 10,000 by the same method as that in Example 1 that the shape of the silver powder was spherical and that the silver powder had no cavities. FIG. 10 shows an electron microscope image obtained by observing the particles of the spherical silver powder at a magnification of 20,000, the particles being confirmed to have no cavities. With respect to the obtained image, the average primary particle diameter $D_{SEM}$ of the spherical silver powder was obtained by the same method as that in Example 1. As a result, the average primary particle diameter $D_{SEM}$ was 2.7 μm.

With respect to the obtained spherical silver powder, the BET specific surface area was measured by the same method as that in Example 1, and the specific surface area diameter $D_{BET}$ was obtained by the same method as that in Example 1. In addition, the particle diameter ($D_{50}$) corresponding to 50% of accumulation in volume-based cumulative distribution of the spherical silver powder was obtained by the same method as that in Example 1. As a result, the BET specific surface area was 0.16 $m^2/g$, and the specific surface area diameter $D_{BET}$ was 3.6 μm. The ratio ($D_{SEM}/D_{BET}$) was 0.8, and the particle diameter ($D_{50}$) was 2.8 μm. With respect to the obtained spherical silver powder, the sintering starting temperature was obtained by the same method as that in Example 1. As a result, the sintering starting temperature was 430° C.

The characteristics of the spherical silver powders obtained in these examples and comparative examples are shown in Tables 1-2.

TABLE 1

| | Shape of Cavities | Size of Elongated Cavities: Major Axis (nm) | Minor Axis (nm) | Major Axis/Minor Axis | Percentage of Cavities to Cross-Sectional Area (%) | |
|---|---|---|---|---|---|---|
| Ex. 1 | elongated | 437 | 34.2 | 12.80 | 1.28 | 2.00 |
| | | 160 | 26.6 | 6.02 | 0.36 | (total) |
| | | 218 | 24.6 | 8.84 | 0.36 | |
| Ex. 2 | elongated | 416 | 32.6 | 12.75 | 0.33 | |
| Ex. 3 | elongated | 952 | 80.7 | 11.80 | 2.53 | |
| Ex. 4 | elongated | 751 | 126 | 5.94 | 1.83 | 2.86 |
| | | 270 | 37.7 | 7.15 | 0.48 | (total) |
| | | 271 | 26.4 | 10.28 | 0.40 | |
| | | 133 | 21.2 | 6.29 | 0.15 | |
| Ex. 5 | elongated | 188 | 36.2 | 5.18 | 0.31 | 0.88 |
| | | 104 | 29.9 | 3.49 | 0.18 | (total) |
| | | 277 | 34.9 | 7.93 | 0.39 | |
| Ex. 6 | elongated | 1111 | 104 | 10.69 | 2.11 | 2.58 |
| | | 250 | 36.7 | 6.82 | 0.24 | (total) |

TABLE 1-continued

| | Shape of Cavities | Size of Elongated Cavities: Major Axis (nm) | Minor Axis (nm) | Major Axis/Minor Axis | Percentage of Cavities to Cross-Sectional Area (%) |
|---|---|---|---|---|---|
| | | 139 | 26.1 | 5.31 | 0.07 |
| | | 234 | 32.6 | 7.16 | 0.16 |
| Ex. 7 | elongated | 571 | 39.4 | 14.51 | 2.05 |
| Ex. 8 | elongated | 903 | 86.9 | 10.39 | 1.23 |
| Comp. 1 | spherical | | — | | — |
| Comp. 2 | — | | — | | — |

TABLE 2

| | $D_{SEM}$ (μm) | BET ($m^2/g$) | $D_{BET}$ (μm) | $D_{SEM}/D_{BET}$ | $D_{50}$ (μm) | Sintering Starting Temp. (° C.) |
|---|---|---|---|---|---|---|
| Ex. 1 | 1.0 | 0.70 | 0.8 | 1.3 | 1.7 | 305 |
| Ex. 2 | 1.4 | 0.72 | 0.8 | 1.8 | 1.4 | 306 |
| Ex. 3 | 1.2 | 0.60 | 1.0 | 1.3 | 1.7 | 311 |
| Ex. 4 | 1.5 | 0.62 | 0.9 | 1.6 | 1.9 | 333 |
| Ex. 5 | 1.5 | 0.58 | 1.0 | 1.5 | 1.7 | 331 |
| Ex. 6 | 1.6 | 0.51 | 1.1 | 1.5 | 2.4 | 354 |
| Ex. 7 | 1.1 | 1.05 | 0.5 | 1.9 | 1.3 | 346 |
| Ex. 8 | 1.4 | 0.72 | 0.8 | 1.8 | 1.7 | 312 |
| Comp. 1 | 1.6 | 0.35 | 1.6 | 1.0 | 3.0 | 410 |
| Comp. 2 | 2.7 | 0.16 | 3.6 | 0.8 | 2.8 | 430 |

It can be seen from these examples and comparative examples that, as the spherical silver powders in examples, the spherical silver powder having a cavity (having a shape which has a major axis of 100 to 1000 nm and a minor axis of 10 nm or more, the ratio of the major axis to the minor axis (major axis/minor axis) being 5 or more) can greatly lower the sintering starting temperature. It can be also seen that it is possible to greatly lower the sintering starting temperature even if the percentage of the cross-sectional area of a corresponding one of the cavities to the cross-sectional area of a corresponding one of the particles of the spherical silver powder is a low percentage of 1% or less as Examples 2 and 5.

It can be seen from these examples and comparative examples that the spherical silver powders in examples can greatly lower the sintering starting temperature. Furthermore, it is considered that, if a corresponding one of the particles of the spherical silver powder having therein a (closed) cavity (which is not communicated with the outside) which extend to be elongated on the cross-section of the corresponding one of the particles of the spherical silver powder as the spherical powders in Examples 1-3, not the substantially spherical cavity as the spherical silver powder in Comparative Example 1, it is possible to greatly lower the sintering starting temperature of the spherical silver powder since the particles of the spherical silver powder are easily deformed by allowing the expansive power to be ununiformly applied in the cavities when residual components are expanded in the cavities by heating the spherical silver powder.

INDUSTRIAL APPLICABILITY

The spherical silver powder according to the present invention can be used for preparing a conductive paste as a spherical silver powder capable of being sintered at a lower temperature. The conductive paste containing this spherical silver powder can be printed on a substrate by a screen printing or the like to be used as an electromagnetic shielding material or the like in addition to electrodes and circuits of electronic parts, such as solar cells, chip parts and touch panels.

The invention claimed is:

1. A spherical silver powder comprising:

spherical silver particles; and cavities, each of which is formed in a corresponding one of the spherical silver particles, wherein each of the cavities has a major axis of 100 to 1000 nm and a minor axis of 10 nm or more, the ratio of the major axis to the minor axis (major axis / minor axis) being 5 or more, the major axis being the length of the long side of a rectangle which has a minimum area and which circumscribes the outline of a cross-section of a corresponding one of the cavities on an image of the cross-section of the corresponding one of the silver particles exposed by polishing the surface of a resin after the silver powder is embedded in the resin, and the minor axis being the length of the narrow side of the rectangle, and wherein each of said cavities is a closed cavity which is not communicated with the outside.

2. A spherical silver powder as set forth in claim 1, which has an average particle diameter $D_{50}$ of 0.5 to 4.0 μm based on a laser diffraction method.

3. A spherical silver powder as set forth in claim 1, which has a specific surface area diameter $D_{BET}$ of 0.1 to 3 μm.

4. A spherical silver powder as set forth in claim 1, which has an average primary particle diameter $D_{SEM}$ of 0.3 to 3 μm.

5. A spherical silver powder as set forth in claim 1, wherein a ratio ($D_{SEM}/D_{BET}$) of an average primary particle diameter $D_{SEM}$ to specific surface area diameter $D_{BET}$ of said spherical silver powder is in the range of from 1.0 to 2.0.

6. A spherical silver powder as set forth in claim 1, which contains an organic substance which has an amino group and a carboxyl group in a structure thereof and which has a cyclic structure.

7. A spherical silver powder as set forth in claim 6, wherein said organic substance has a molecular weight of not less than 100.

8. A spherical silver powder, comprising:

spherical silver particles; and cavities, each of which is formed in a corresponding one of the spherical silver particles, wherein each of the cavities has a major axis of 100 to 1000 nm and a minor axis of 10 nm or more, the ratio of the major axis to the minor axis (major axis / minor axis) being 5 or more, the major axis being the length of the long side of a rectangle which has a minimum area and which circumscribes the outline of a cross-section of a corresponding one of the cavities on an image of the cross-section of the corresponding one of the silver particles exposed by polishing the surface of a resin after the silver powder is embedded in the resin, and the minor axis being the length of the narrow side of the rectangle, and wherein the percentage of a cross-sectional area of said cavities to a cross-sectional area of said silver particles is 10% or less on the cross-section of said silver particles.

9. A spherical silver powder as set forth in claim 8, which has an average particle diameter $D_{50}$ of 0.5 to 4.0 μm based on a laser diffraction method.

10. A spherical silver powder as set forth in claim 8, which has a specific surface area diameter $D_{BET}$ of 0.1 to 3 μm.

11. A spherical silver powder as set forth in claim 8, which has an average primary particle diameter $D_{SEM}$ of 0.3 to 3 μm.

12. A spherical silver powder as set forth in claim 8, wherein a ratio ($D_{SEM}/D_{BET}$) of an average primary particle diameter $D_{SEM}$ to specific surface area diameter $D_{BET}$ of said spherical silver powder is in the range of from 1.0 to 2.0.

13. A spherical silver powder as set forth in claim 8, which contains an organic substance which has an amino group and a carboxyl group in a structure thereof and which has a cyclic structure.

14. A spherical silver powder as set forth in claim 13, wherein said organic substance has a molecular weight of not less than 100.

15. A spherical silver powder comprising:

spherical silver particles; and cavities, each of which is formed in a corresponding one of the spherical silver particles, wherein each of the cavities has a major axis of 100 to 1000 nm and a minor axis of 10 nm or more, the ratio of the major axis to the minor axis (major axis / minor axis) being 5 or more, the major axis being the length of the long side of a rectangle which has a minimum area and which circumscribes the outline of a cross-section of a corresponding one of the cavities on an image of the cross-section of the corresponding one of the silver particles exposed by polishing the surface of a resin after the silver powder is embedded in the resin, and the minor axis being the length of the narrow side of the rectangle, and wherein the spherical silver powder has a BET specific surface area of 0.1 to 1.5 $m^2/g$.

16. A spherical silver powder as set forth in claim 15, which has an average particle diameter $D_{50}$ of 0.5 to 4.0 μm based on a laser diffraction method.

17. A spherical silver powder as set forth in claim 15, which has a specific surface area diameter $D_{BET}$ of 0.1 to 3 μm.

18. A spherical silver powder as set forth in claim 15, which has an average primary particle diameter $D_{SEM}$ of 0.3 to 3 μm.

19. A spherical silver powder as set forth in claim 15, wherein a ratio ($D_{SEM}/D_{BET}$) of an average primary particle diameter $D_{SEM}$ to specific surface area diameter $D_{BET}$ of said spherical silver powder is in the range of from 1.0 to 2.0.

20. A spherical silver powder as set forth in claim 15, which contains an organic substance which has an amino group and a carboxyl group in a structure thereof and which has a cyclic structure.

21. A spherical silver powder as set forth in claim 20, wherein said organic substance has a molecular weight of not less than 100.

22. A spherical silver powder comprising:

spherical silver particles; and cavities, each of which is formed in a corresponding one of the spherical silver particles, wherein each of the cavities has a major axis of 100 to 1000 nm and a minor axis of 10 nm or more, the ratio of the major axis to the minor axis (major axis / minor axis) being 5 or more, the major axis being the length of the long side of a rectangle which has a minimum area and which circumscribes the outline of a cross-section of a corresponding one of the cavities on an image of the cross-section of the corresponding one of the silver particles exposed by polishing the surface of a resin after the silver powder is embedded in the resin, and the minor axis being the length of the narrow side of the rectangle, and wherein the shrinking percentage of the spherical silver powder reaches 10% at a temperature of not higher than 360° C. when the spherical silver powder is heated.

23. A spherical silver powder as set forth in claim 22, which has an average particle diameter $D_{50}$ of 0.5 to 4.0 μm based on a laser diffraction method.

24. A spherical silver powder as set forth in claim 22, which has a specific surface area diameter $D_{BET}$ of 0.1 to 3 μm.

25. A spherical silver powder as set forth in claim 22, which has an average primary particle diameter $D_{SEM}$ of 0.3 to 3 μm.

26. A spherical silver powder as set forth in claim 22, wherein a ratio ($D_{SEM}/D_{BET}$) of an average primary particle diameter $D_{SEM}$ to specific surface area diameter $D_{BET}$ of said spherical silver powder is in the range of from 1.0 to 2.0.

27. A spherical silver powder as set forth in claim 22, which contains an organic substance which has an amino group and a carboxyl group in a structure thereof and which has a cyclic structure.

28. A spherical silver powder as set forth in claim 22, wherein said organic substance has a molecular weight of not less than 100.

* * * * *